US008474935B2

(12) United States Patent
Sumi

(10) Patent No.: US 8,474,935 B2
(45) Date of Patent: Jul. 2, 2013

(54) IMAGE FORMING APPARATUS AND RECORDING HEAD ADJUSTING METHOD

(75) Inventor: Katsuto Sumi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 483 days.

(21) Appl. No.: 12/412,097

(22) Filed: Mar. 26, 2009

(65) Prior Publication Data

US 2009/0267977 A1 Oct. 29, 2009

(30) Foreign Application Priority Data

Mar. 28, 2008 (JP) ..... 2008-087833

(51) Int. Cl.
*B41J 29/38* (2006.01)

(52) U.S. Cl.
USPC ..... 347/12; 347/13; 347/9

(58) Field of Classification Search
USPC ..... 347/5, 9, 12, 13, 42
See application file for complete search history.

(56) References Cited

U.S. PATENT DOCUMENTS 6,062,666 A * 5/2000 Omata et al. ..... 347/12
6,457,800 B1 10/2002 Böhm et al.
6,554,398 B2 * 4/2003 Wyngaert et al. ..... 347/42
6,738,162 B1 5/2004 Martens et al.
2002/0126169 A1 9/2002 Wyngaert et al.
2005/0073539 A1 4/2005 McGarry et al.
2007/0008359 A1 * 1/2007 Suzuki et al. ..... 347/12

FOREIGN PATENT DOCUMENTS

JP 2002-79657 A 3/2002
JP 2005-53167 A 3/2005
JP 2005-111990 A 4/2005
JP 2006-35431 A 2/2006
JP 2006-116845 A 5/2006
JP 2008-12701 A 1/2008
JP 2008-12712 A 1/2008

* cited by examiner

*Primary Examiner* — Lam S Nguyen
(74) *Attorney, Agent, or Firm* — Birch, Stewart, Kolasch & Birch, LLP

(57) ABSTRACT

An image forming apparatus includes: a recording head having plural sub-heads, the sub-heads each including plural nozzles, each of the plural nozzles within a sub-head ejecting liquid droplets at the same time with respect to a medium on which an image is drawn, and the sub-heads being arranged in a width direction of the medium; a setting unit; and a rotation unit. The setting unit uses a timing when a predetermined sub-head of the plural sub-heads ejects liquid droplets as a reference to set timings when sub-heads other than the predetermined sub-head eject liquid droplets. The rotation unit uses a predetermined axis as a spindle to rotate and position the recording head in a plane parallel to a plane of the medium.

14 Claims, 17 Drawing Sheets

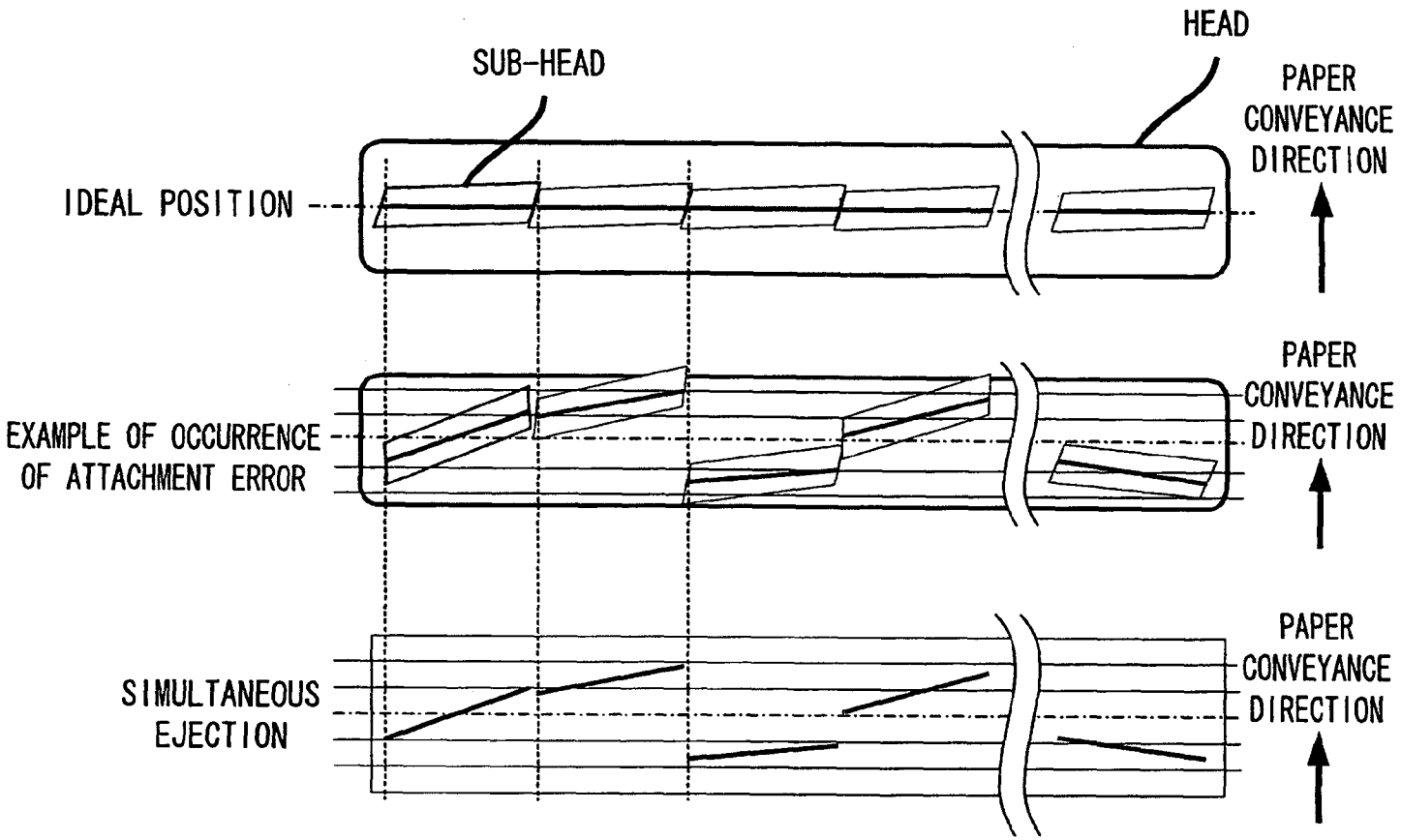
FIG. 16A <RELATED ART>
FIG. 16B <RELATED ART>
FIG. 16C <RELATED ART>

<RELATED ART>

<RELATED ART>

IMAGE FORMING APPARATUS AND RECORDING HEAD ADJUSTING METHOD

CROSS-REFERENCE TO RELATED APPLICATION

This application claims priority under 35 USC 119 from Japanese Patent Application No. 2008-087833, the disclosure of which is incorporated by reference herein.

BACKGROUND OF THE INVENTION

1. Field of the Invention

The present invention relates to an image forming apparatus and a recording head adjusting method and particularly relates to an image forming apparatus that forms an image by a recording head configured by plural sub-heads and a recording head adjusting method that adjusts shift that has arisen between the sub-heads.

2. Description of the Related Art

A head in a single-pass format image forming apparatus is often configured by plural sub-heads. These plural sub-heads are manufactured as one head as a result of being positioned and attached. Due to misalignment that occurs at the time of attachment, the sub-heads are not attached in ideal positions shown in FIG. 16A, and shift often arises in the attachment positions of the sub-heads as shown in FIG. 16B.

Misalignment of the sub-heads lowers image quality because, as shown in FIG. 16C, shift arises at connecting portions of the sub-heads when ink is ejected simultaneously by the sub-heads. In Japanese Patent Application Laid-Open Publication (JP-A) No. 2005-111990, there is disclosed a technology that corrects by adjusting, in print head units or nozzle units, timings of ink ejection (jetting). This technology addresses print quality deterioration resulting from mutual misalignment between plural print heads. An image that the print heads have drawn is detected with an optical sensor. "x/y/rotation offset" information is acquired. The timings of ink ejection (jetting) is corrected on the basis of that information.

SUMMARY OF THE INVENTION

The present invention provides an image forming apparatus and a recording head adjusting method.

According to an aspect of the invention, there is provided an image forming apparatus including: a recording head having plural sub-heads, the sub-heads each including plural nozzles, each of the plural nozzles within a sub-head ejecting liquid droplets at the same time with respect to a medium on which an image is drawn, and the sub-heads being arranged in a width direction of the medium; a setting unit that uses a timing when a predetermined sub-head of the plural sub-heads ejects liquid droplets as a reference to set timings when sub-heads other than the predetermined sub-head eject liquid droplets; and a rotation unit that uses a predetermined axis as a spindle to rotate and position the recording head in a plane parallel to a plane of the medium.

According to another aspect of the invention, there is provided a recording head adjusting method including: using, in a recording head where plural sub-heads that include plural nozzles, each of the plural nozzles within a sub-head ejecting liquid droplets at the same time with respect to a medium on which an image is drawn and the sub-heads being arranged in a width direction of the medium, a timing when a predetermined sub-head of the plural sub-heads ejects liquid droplets as a reference to set timings when sub-heads other than the predetermined sub-head eject liquid droplets; and using a predetermined axis as a spindle to rotate and position the recording head in a plane parallel to a plane of the medium.

BRIEF DESCRIPTION OF THE DRAWINGS

Preferred embodiments of the present invention will be described in detail based on the following figures, wherein:

FIG. 16A to FIG. 16C are diagrams showing a conventional example (part 1)

DETAILED DESCRIPTION OF THE INVENTION

What becomes a problem in the aforementioned misalignment between the sub-heads are variations between the sub-heads. With respect thereto, JP-A No. 2005-111990 proposes correcting rotation offset by adjusting the timings of ejection (jetting) in nozzle units in accordance with rotation offset.

However, in order to adjust the ejection (jetting) timings in nozzle units and realize rotation correction of a minute angle, a function of selecting between and setting a timing signal of an extremely high resolution and a timing signal in nozzle units becomes necessary, and the head drive circuit becomes complicated and expensive.

Thus, using a sub-head where plural nozzles inside the sub-head are ejection-controlled at same timings is desired. However, in that case, the following phenomena arise due to variations between the sub-heads.

Figure 17A:
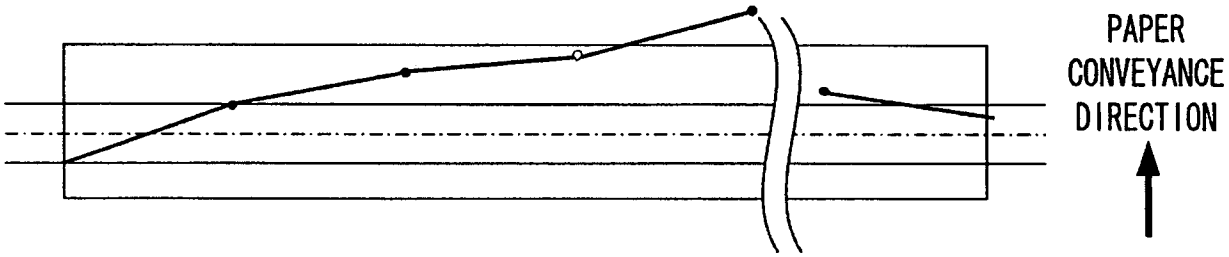
FIG. 17A and FIG. 17B are diagrams showing the conventional example (part 2).

First, color shift occurs. Specifically, as shown in FIG. 17A, when the ejection timings are adjusted so as to connect ends of the drawn images of the sub-heads, shift from ideal positions of the drawn images of the entire width, or in other words registration-associated shift, becomes bad due to variations resulting from misalignment of the sub-heads. Variations in registration between heads of respective colors arise, and color shift (shift between colors) occurs.

Figure 17B:
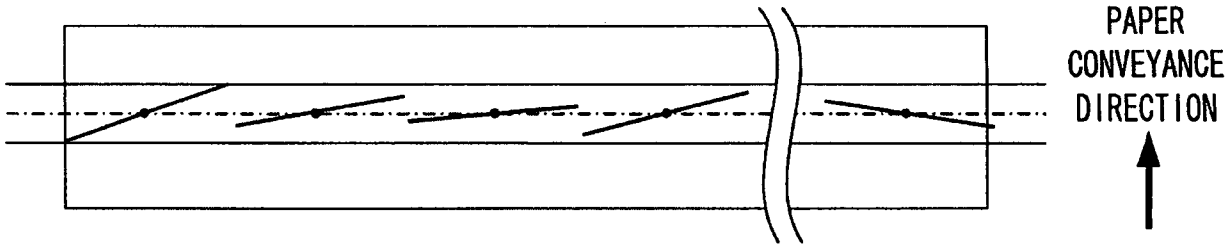

Further, unevenness (irregularity, nonuniformity) occurs in connecting portions. Specifically, as shown in FIG. 17B, when the ejection timings are adjusted so as to cause drawn images of the sub-heads to averagely coincide with ideal positions, and specifically such that center positions of the sub-heads coincide with ideal positions, the images at the connecting portions of the sub-heads shift in the paper conveyance direction. Thus, unevenness occurs in the connecting portions.

In this manner, the prior art cannot control color shift and unevenness of connecting portions generated by misalignment of sub-heads that eject ink droplets.

The present invention provides an image forming apparatus that controls color shift and unevenness of connecting portions generated by misalignment of sub-heads that eject ink droplets and a recording head adjusting method that adjusts shift that has arisen between the sub-heads.

Below, embodiments of the present invention will be described in detail with reference to the drawings. It will be noted that, in the description below, an example where a recording medium is used as medium on which an image is drawn will be described. In a case where the medium on which an image is drawn is another medium, such as a transfer belt, the embodiments of the present invention can also be applied to a medium other than a recording medium by substituting that medium for "recording medium". Further, in the embodiments, a belt-conveyance format image forming apparatus will be taken as an example and described, but "plane of the medium" is not limited to a flat plane of a belt in a belt-conveyance format and also includes a tangential plane of a curved surface in a drum-conveyance format.

Figure 1:
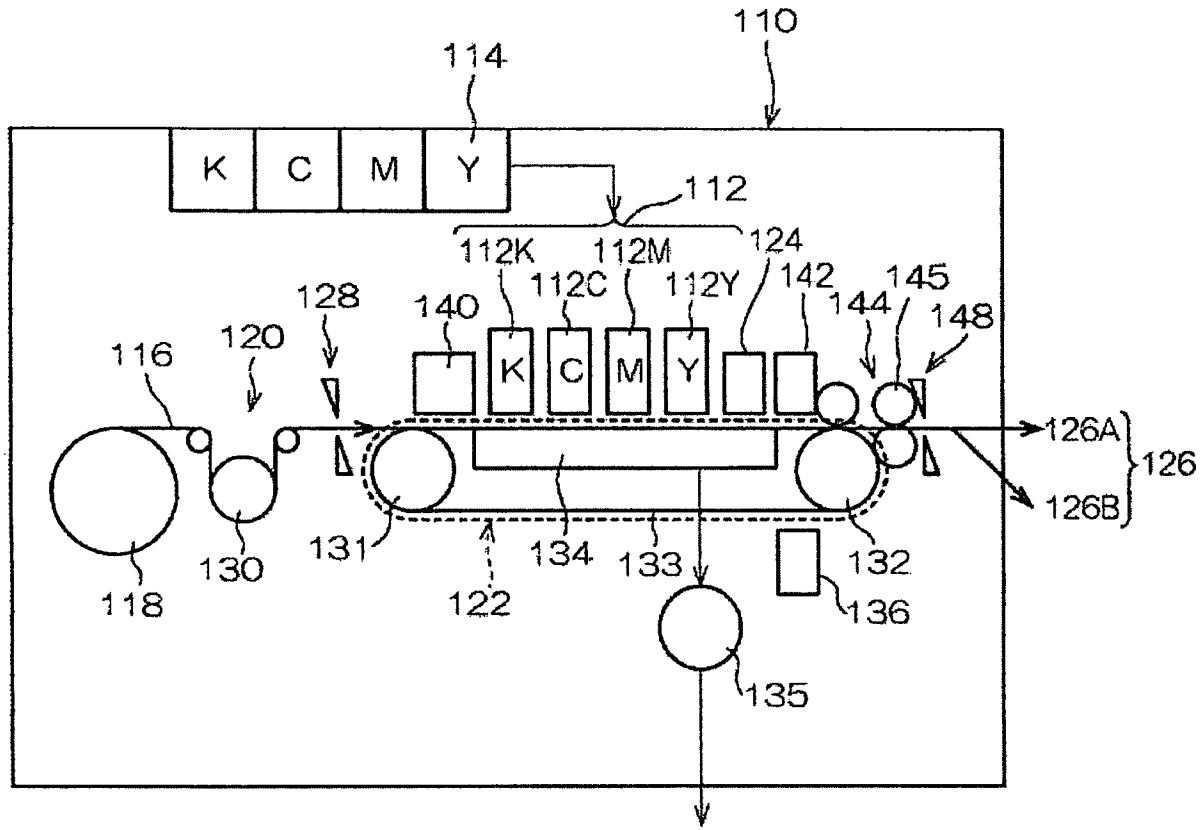
FIG. 1 is a side diagram showing the overall configuration of an inkjet recording apparatus pertaining to the embodiments.

FIG. 1 is an overall configural diagram of an inkjet recording apparatus 110 showing an embodiment of the image forming apparatus pertaining to the present invention. As shown in FIG. 1, this inkjet recording apparatus 110 is disposed with: a printing unit 112 that includes plural recording heads (hereinafter called "heads") 112K, 112C, 112M and 112Y that are disposed in correspondence to inks of black (K), cyan (C), magenta (M) and yellow (Y); an ink storing/charging unit 114 that stores the inks supplied to the heads 112K, 112C, 112M and 112Y; a paper supplying unit 118 that supplies recording paper 116 that is a recording medium; a decurling unit 120 that decurls the recording paper 116; a belt conveyance unit 122 that is disposed facing a nozzle surface (an ink ejection surface) of the printing unit 112 and conveys the recording paper 116 while preserving the planarity of the recording paper 116; a printing detecting unit 124 that reads the printing result resulting from the printing unit 112; and a paper discharging unit 126 that discharges the recorded recording paper 116 (print matter) to the outside. It will be noted that "printing" in the present specification includes the printing of characters and also the printing of images.

The ink storing/charging unit 114 includes ink tanks that store inks of colors corresponding to the heads 112K, 112C, 112M and 112Y, and the tanks are communicated with the heads 112K, 112C, 112M and 112Y via necessary pipe lines. Further, the ink storing/charging unit 114 is disposed with an informing unit that informs an operator when remaining amounts of the inks become small, and the ink storing/charging unit 114 includes a mechanism for preventing erroneous filling between colors.

In FIG. 1, there is shown a magazine of roll paper (continuous paper) as one example of the paper supplying unit 118. The inkjet recording apparatus 110 may also be disposed with plural magazines whose paper width and paper quality are different. Further, instead of, or in joint use together with, a magazine of roll paper, the paper may also be supplied by a cassette into which cut paper has been stacked and loaded.

When the inkjet recording apparatus 110 is configured to be capable of utilizing plural types of recording media, it is preferred to automatically distinguish the type of recording medium (media types) to be used by attaching to the magazine an information recording body such as a barcode or a wireless tag in which media type information is recorded and reading the information of that information recording body with a predetermined reading device and to perform ink ejection control so as to realize appropriate ink ejection in accordance with the media types.

The recording paper 116 that is fed from the paper supplying unit 118 curls as a result of having been loaded in the magazine. In order to decurl the recording paper 116, in the decurling unit 120, heat is applied to the recording paper 116 by a heating drum 130 in the opposite direction of the curling direction of the magazine. At this time, it is more preferred to control the heating temperature such that a printing surface of the recording paper 116 somewhat weakly curls outward.

In the case of an apparatus configuration that uses roll paper, as shown in FIG. 1, a cutter 128 for cutting is disposed such that the roll paper is cut into a desired size by the cutter 128. It will be noted that, in a case where the apparatus uses cut paper, the cutter 128 is unnecessary.

The recording paper 116 that has been cut after having been decurled is fed to the belt conveyance unit 122. The belt conveyance unit 122 is configured to have a structure where an endless belt 133 is wrapped between rollers 131 and 132.

The belt 133 has a width dimension that is wider than the width of the recording paper 116, and numerous suction holes (not shown) are formed in the belt surface. As shown in FIG. 1, an adsorption chamber 134 is disposed in a position facing the nozzle surface of the printing unit 112 and a sensor surface of the printing detecting unit 124 on the inner side of the belt 133 wrapped between the rollers 131 and 132. This adsorption chamber 134 is sucked and placed in a negative pressure state by a fan 135, whereby the recording paper 116 is adsorbed to and held on the belt 133. It will be noted that, instead of a suction adsorption format, an electrostatic adsorption format may also be employed.

Motive power of an unillustrated motor is transmitted to at least one of the rollers 131 and 132 around which the belt 133 is wrapped, whereby the belt 133 is driven in a clockwise direction in FIG. 1, and the recording paper 116 held on the belt 133 is conveyed from left to right in FIG. 1.

When the inkjet recording apparatus 110 prints a marginless print or the like, the inks also adhere to the top of the belt 133, so a belt cleaning unit 136 is disposed in a predetermined position on the outer side of the belt 133 (an appropriate position outside of a printing region). Although details are not shown in regard to the configuration of the belt cleaning unit 136, there are, for example, a format that nips a brush roll or a water-absorbing roll, an air blow format that blows cleaning air, or a combination of these. In the case of a format that nips a cleaning roll, the cleaning effect is large when the belt linear velocity and the roller linear velocity are changed.

It will be noted that, instead of the belt conveyance unit 122, an aspect that uses a roller nip conveyance mechanism is also conceivable. When the printing region is nipped between and conveyed by rollers, the rollers contact the printing surface of the paper immediately after printing, so it is easy for the image to run (color blurring occurs). Consequently, adsorption belt conveyance that does not contact the image surface in the printing region, as in the present example, is preferred.

A heating fan 140 is disposed on the upstream side of the printing unit 112 on a paper conveyance path formed by the belt conveyance unit 122. The heating fan 140 blows hot air onto the recording paper 116 before printing and heats the recording paper 116. By heating the recording paper 116 immediately before printing, it becomes easier for the inks to dry after they land.

Figure 2:
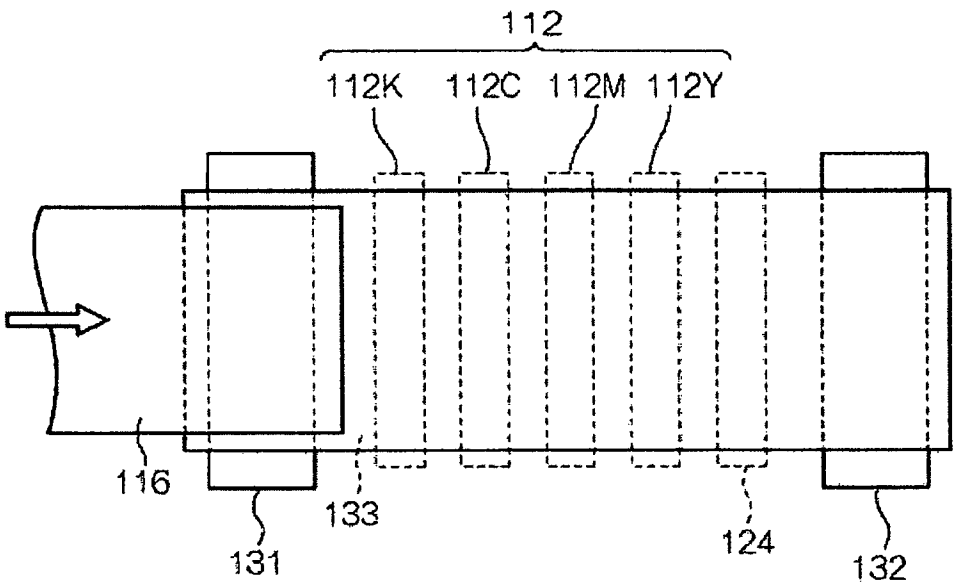
FIG. 2 is a plan diagram showing the configuration of a printing unit and its periphery of the inkjet recording apparatus pertaining to the embodiments.

The heads 112K, 112C, 112M and 112Y of the printing unit 112 have a length corresponding to the maximum paper width of the recording paper 116 intended for the inkjet recording apparatus 110. The heads are full-line heads, and nozzles for ink ejection are plurally arrayed on their nozzle surfaces across a length extending beyond at least one side of the maximum-size recording paper 116 (the entire width of the drawable range) (see FIG. 2).

The heads 112K, 112C, 112M and 112Y are arranged in the color order of black (K), cyan (C), magenta (M) and yellow (Y) from the upstream side along a feeding direction of the recording paper 116. The heads 112K, 112C, 112M and 112Y are fixedly installed so as to extend along a direction substantially orthogonal to the conveyance direction of the recording paper 116.

The inks of the respectively different colors are ejected onto the recording paper 116 from the heads 112K, 112C, 112M and 112Y while the recording paper 116 is conveyed by the belt conveyance unit 122, whereby a color image can be formed on the recording paper 116.

In this manner, according to the configuration where the full-line heads 112K, 112C, 112M and 112Y that include nozzle rows covering the entire region of the paper width are disposed separately by color, an image can be recorded on the entire surface of the recording paper 116 simply by performing, one time (that is, one-time sub-scanning), operation of causing the recording paper 116 and the printing unit 112 to relatively move in regard to the paper feeding direction (a sub-scanning direction). Thus, the heads are capable of high-speed printing in comparison to a shuttle head where the recording head reciprocally operates in a direction orthogonal to the paper conveyance direction, and productivity can be improved.

In the present example, there is exemplified a configuration of the standard colors (four colors) KCMY, but the combination of ink colors and number of colors is not limited to the present embodiment. Light inks, dark inks and special color inks may also be added as needed. For example, a configuration that adds inkjet heads that eject light inks such as light cyan and light magenta is also possible. Further, there is no particular limitation on the arrangement order of the color heads.

The printing detecting unit 124 shown in FIG. 1 includes an image sensor (a line sensor or area sensor) for imaging the droplet (impact) result of the printing unit 112 and functions as means that checks ejection characteristics, such as nozzle clogging and landing position error, from the droplet image that has been read by the image sensor.

For the printing detecting unit 124 of the present example, there can be suitably used a CCD area sensor where plural light-receiving elements (photoelectric conversion elements) are two-dimensionally arrayed on a light-receiving surface. It will be assumed that the area sensor has an imaging range that can at least image the entire region of the ink ejection width (image recording width) resulting from the heads 112K, 112C, 112M and 112Y. The necessary imaging range may be realized by one area sensor, or the necessary imaging range may be ensured by combining (connecting) plural area sensors. Or, a configuration that images the necessary imaging range by supporting an area sensor with a moving mechanism (not shown) and moving (scanning) the area sensor is also possible.

Further, it is also possible to use a line sensor instead of an area sensor. In this case, a configuration that includes a light-receiving element row (photoelectric conversion element row) whose width is wider than at least the ink ejection width (image recording width) resulting from the heads 112K, 112C, 112M and 112Y is preferred.

In this manner, the printing detecting unit 124 is a block including an image sensor, reads an image that has been printed on the recording paper 116, performs necessary signal processing and the like to detect the printing situation (whether or not ejection has been performed, landing position error, dot shape, optical density, etc.), and provides that detection result to a print control unit 180 and a system controller 172.

A post-drying unit 142 is disposed downstream of the printing detecting unit 124. The post-drying unit 142 is means that dries the image surface that has been printed, and, for example, a heating fan is used. It is preferable to avoid contacting the printing surface until the inks after printing have dried, so a format that blows hot air is preferred.

In a case where dye-based inks are printed on porous paper, there is the effect that weatherability of the image increases because contact with things such as ozone that cause destruction of dye molecules is prevented because the holes in the paper are filled in by pressurization.

A heating/pressuring unit 144 is disposed downstream of the post-drying unit 142. The heating/pressuring unit 144 is means for controlling the glossiness of the image surface. The heating/pressuring unit 144 pressures, while heating, the image surface with a pressure roller 145 having a predetermined surface-uneven shape and transfers the uneven shape to the image surface.

The print matter that has been produced in this manner is discharged from the paper discharging unit 126. Normally it is preferred to separate and discharge an actual image that is to be printed (something on which a target image has been printed) from test printing. In this inkjet recording apparatus 110, there is disposed sorting means (not shown) that sorts between print matter of an actual image and print matter of test printing and switches the paper discharge path in order to send these to respective discharging units 126A and 126B.

It will be noted that, when an actual image and test printing are simultaneously formed in parallel on large paper, the test printing portion is cut off by a cutter 148. Further, in the discharging unit 126A of an actual image, there is disposed a sorter (not shown) that accumulates images separately by order.

Next, the structure of the heads will be described. The color-separate heads 112K, 112C, 112M and 112Y have the same structure, so below, reference numeral 150 will represent these heads.

Figure 3:
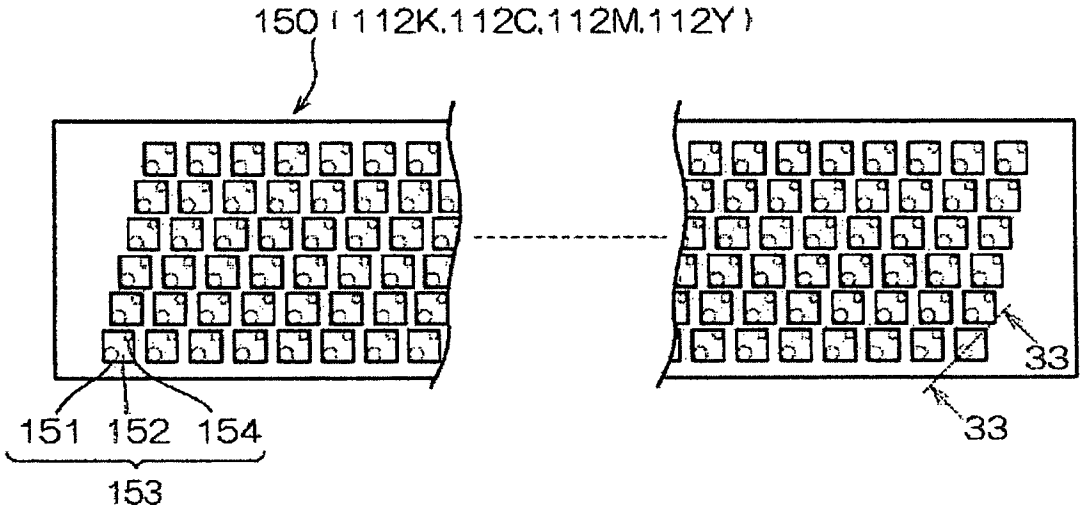
FIG. 3 is a plan transparent diagram showing a structural example of a head of the inkjet recording apparatus pertaining to the embodiments.
Figure 4:
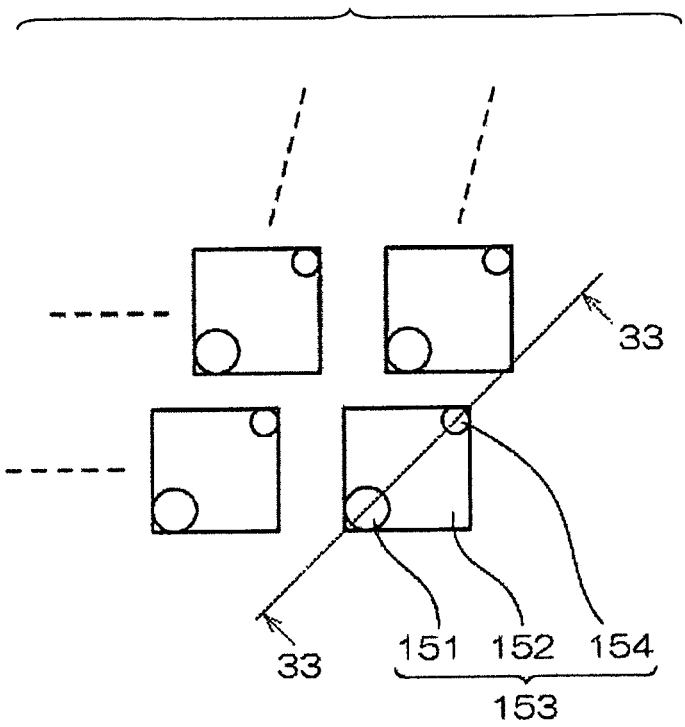
FIG. 4 is an enlarged diagram of an ink chamber unit in FIG. 3.
Figure 5:
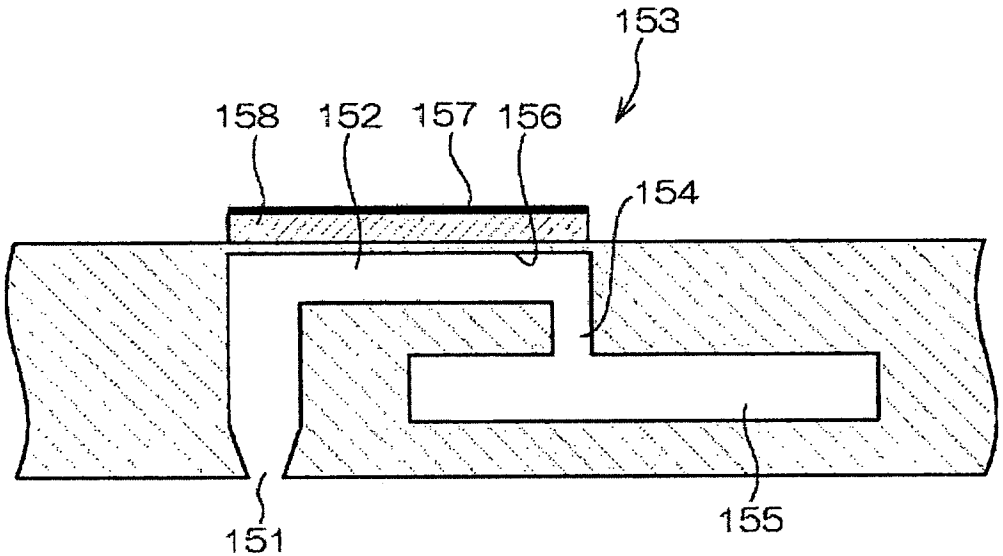
FIG. 5 is a cross-sectional diagram cut along line 33-33 in FIG. 3.

FIG. 3 is a plan transparent diagram showing a structural example of the head 150, and FIG. 4 is an enlarged diagram of part of FIG. 3. Further, FIG. 5 is a cross-sectional diagram (a cross-sectional diagram along line 33-33 in FIG. 4) showing the three-dimensional configuration of one liquid droplet ejecting element (an ink chamber unit corresponding to one nozzle 151).

In order to densify the pitch of the dots to be printed on the recording paper 116, it is necessary to densify the pitch of the nozzles in the head 150. In the head 150 of the present example, as shown in FIG. 3 and FIG. 4, plural ink chamber units (liquid droplet ejecting elements) 153, each of which comprises a nozzle 151 that is an ink ejection opening and a pressure chamber 152 that corresponds to the nozzle 151, are staggeringly arranged in a in a matrix (two-dimensionally). Thus, densification of the substantial inter-nozzle distance (projected nozzle pitch) projected so as to be along the head longitudinal direction (direction orthogonal to the paper feeding direction) is achieved.

It will be noted that the mode of configuring one or more nozzle rows across a length corresponding to the entire width of the recording paper 116 in a direction substantially orthogonal to the feeding direction of the recording paper 116 is not limited to the present embodiment.

Each of the pressure chambers 152 that are disposed in correspondence to the nozzles 151 has a generally square planar shape (see FIG. 3 and FIG. 4), with an outflow opening that leads to the nozzle 151 being disposed in one of both corner portions on a diagonal line and with a supply ink inflow opening (supply opening) 154 being disposed in the other of the corner portions on the diagonal line. It will be noted that the shape of the pressure chambers 152 is not limited to the shape in the present example and that a wide variety of configurations are possible. For example, the pressure chambers 152 may also have a quadrilateral (rhombic, rectangular, etc.), pentagonal, hexagonal or other polygonal planar shape, or the pressure chambers 152 may also have a circular or elliptical planar shape.

As shown in FIG. 5, each of the pressure chambers 152 is communicated with a common flow path 155 via the supply opening 154. The common flow path 155 is communicated with an ink tank (not shown) that is an ink supply source, and ink supplied from the ink tank is distributed and supplied to each of the pressure chambers 152 via the common flow path 155.

An actuator 158 disposed with an individual electrode 157 is joined to a pressure plate (diaphragm that doubles as a common electrode) 156 that configures a surface (in FIG. 5, a ceiling surface) of part of the pressure chamber 152. A drive voltage is supplied between the individual electrode 157 and the common electrode, whereby the actuator 158 deforms, the volume of the pressure chamber 152 changes, and the ink is ejected from the nozzle 151 by an accompanying change in pressure. It will be noted that a piezoelectric element using a piezoelectric body such as lead zirconate titanate or barium titanate is suitably used for the actuator 158. After ink ejection, when displacement of the actuator 158 returns to before, the pressure chamber 152 is refilled with new ink through the supply opening 154 from the common flow path 155.

By controlling the driving of the actuators 158 corresponding to the nozzles 151 in accordance with dot arrangement data produced from image information, ink droplets can be ejected from the nozzles 151. As has been described in FIG. 1, the inkjet recording apparatus 110 controls the ink ejection timings of the nozzles 151 to match the conveyance speed of the recording paper 116 while conveying the recording paper 116 that is a recording medium at a constant speed in the sub-scanning direction. In this manner, the inkjet recording apparatus 110 can record a desired image on the recording paper 116.

Figure 6:
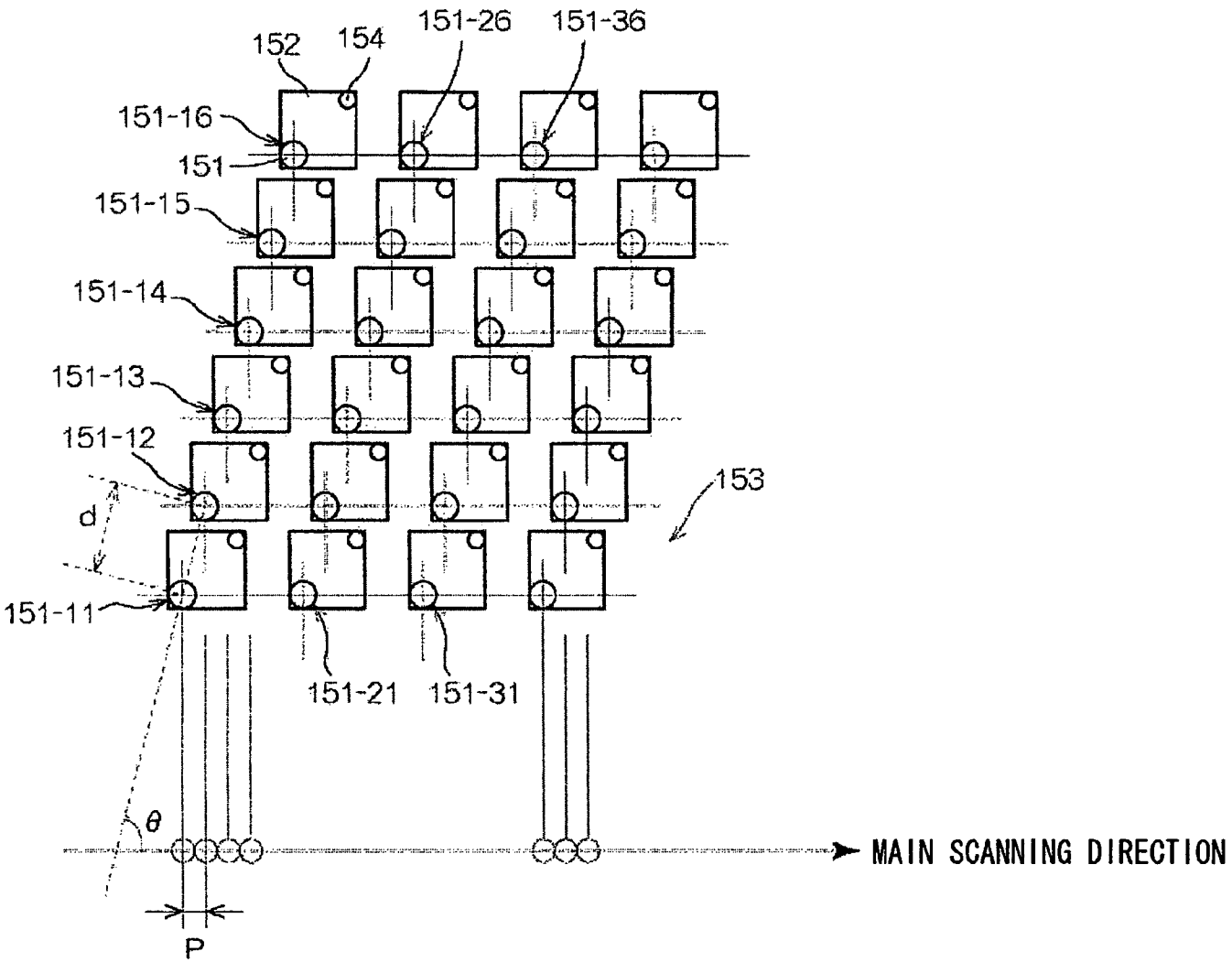
FIG. 6 is a general diagram showing an example of a nozzle array of the head of the inkjet recording apparatus pertaining to the embodiments.

The ink chamber units 153 are, as shown in FIG. 6, numerously arrayed in a lattice manner in a constant array pattern along a column direction along a main scanning direction and a diagonal row direction having a constant angle θ that is not orthogonal with respect to the main scanning direction. Thus, the high-density nozzle head of the present example is realized.

That is, the ink chamber units 153 are plurally arrayed at a constant pitch d along the direction of the certain angle θ with respect to the main scanning direction. A pitch P of the nozzles projected so as to be along the main scanning direction becomes equal to d×cos θ. In regard to the main scanning direction, the nozzles 151 can be treated equivalently as being arrayed in a straight line at the constant pitch P. Because of this configuration, it becomes possible for the nozzle rows projected so as to be along the main scanning direction to realize a high-density nozzle configuration of 2400 per inch (2400 nozzles/inch).

"Sub-scanning" is defined as repeatedly performing printing of one line (a line resulting from one row of dots or a line comprising plural rows of dots) that has been formed by the aforementioned main scanning by relatively moving the aforementioned full-line head and the paper.

Additionally, "main scanning direction" refers to the direction represented by one line (or the longitudinal direction of a band-like region) that is recorded by the aforementioned main scanning, and "sub-scanning direction" refers to the direction in which the aforementioned sub-scanning is performed. That is, in the present embodiment, the conveyance direction of the recording paper 116 is the sub-scanning direction, and the direction orthogonal to that is the main scanning direction.

The arrangement structure of the nozzles when implementing the present invention is not limited to the example shown in the drawings. Further, in the present embodiment, there is employed a format where ink droplets are ejected by deformation of the actuators 158 represented by piezo elements (piezoelectric elements), but the format by which the inks are ejected is not particularly limited. Instead of a piezo-jet format, various types of formats can be applied, such as a thermal-jet format where the inks are heated by a heating element such as a heater to generate air bubbles and where ink droplets are ejected by the pressure thereof.

Figure 7:
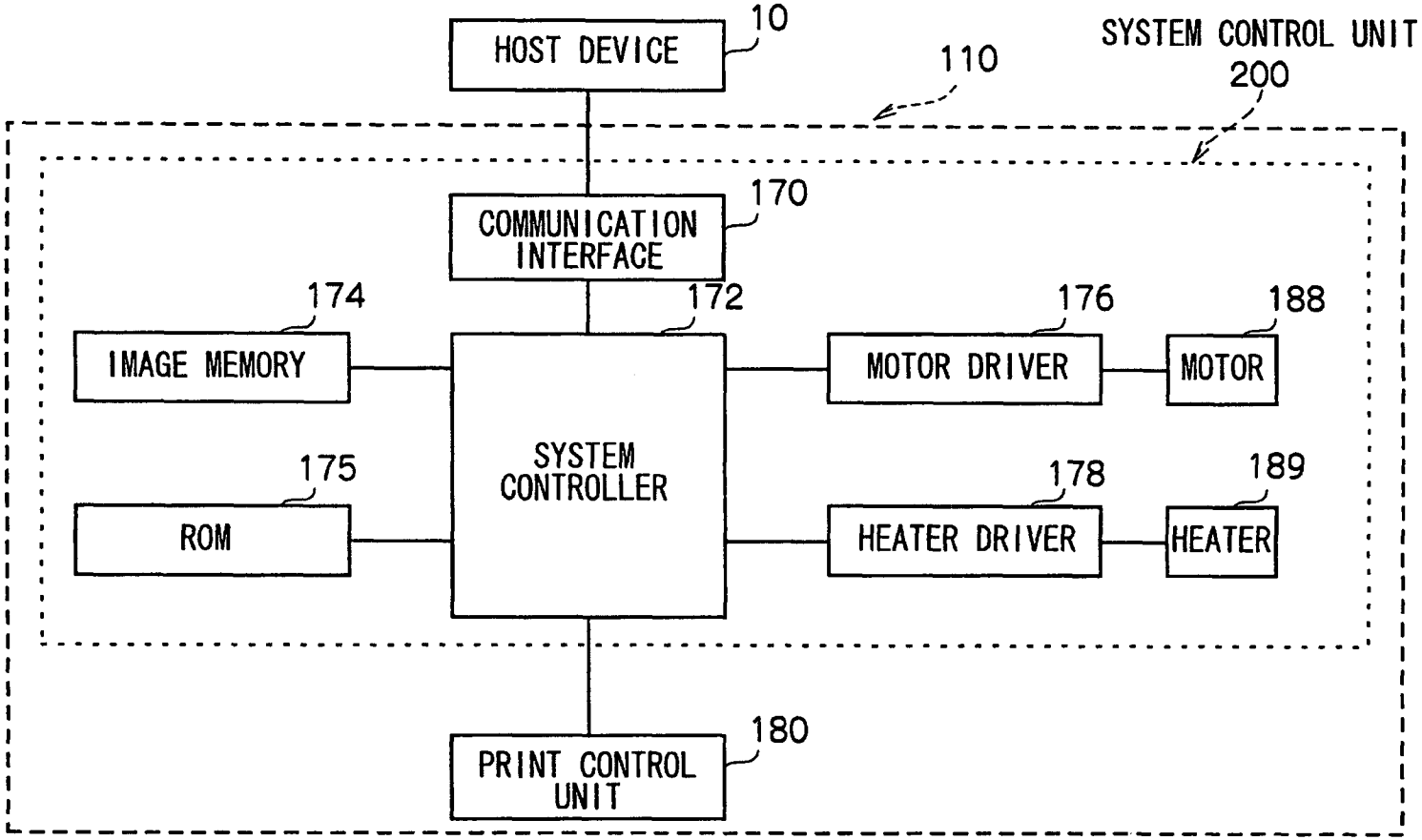
FIG. 7 is a general diagram showing an example of an electrical configuration of the inkjet recording apparatus pertaining to the embodiments.

FIG. 7 is a block diagram showing a system configuration of the inkjet recording apparatus 110. As shown in FIG. 7, the inkjet recording apparatus 110 is, broadly divided, configured to include a system control unit 200 and a print control unit 180.

The system control unit 200 is disposed with a communication interface 170, a system controller 172, an image memory 174, a ROM 175, a motor driver 176 and a heater driver 178.

The communication interface 170 is an interface unit for interfacing with a host device 10 that is used in order for the operator to issue a printing instruction or the like with respect to the inkjet recording apparatus 110. A serial interface, such as Universal Serial Bus (USB), IEEE 1394, Ethernet® or a wireless network, or a parallel interface, such as the Centronics parallel interface, can be applied as the communication interface 170. A buffer memory (not shown) for increasing the speed of communication may also be installed in this portion.

Image data that have been sent from the host device 10 are inputted to the inkjet recording apparatus 110 via the communication interface 170 and are temporarily stored in the image memory 174. The image memory 174 is storage unit that stores images that have been inputted via the communication interface 170, and data reading and writing are performed through the system controller 172. The image memory 174 is not limited to a memory comprising a semiconductor element, and a magnetic medium such as a hard disk may also be used.

The system controller 172 is configured by a central processing unit (CPU) and peripheral circuits, functions as a control device that controls the entire inkjet recording apparatus 110 in accordance with a predetermined program, and also functions as a processing unit that performs various types of processing. That is, the system controller 172 controls the communication interface 170, the image memory 174, the motor driver 176, the heater driver 178 and the print control unit 180, controls communication with the host device 10, and controls reading and writing of the image memory 174 and the ROM 175. Further, the system controller 172 generates control signals that control a motor 188 of the conveyance system and a heater 189. It will be noted that, in addition to control signals, the system controller 172 transmits the image information stored in the image memory 174 to the print control unit 180. Further, the system controller 172 can also generate landing position error data and dot shape data from reading data that the system controller 172 has read from the printing detecting unit 124.

Further, programs that the CPU of the system controller 172 executes and various types of data necessary for control are stored in the ROM 175. The ROM 175 may also be a non-rewritable storage unit. When various types of data are to be updated as needed, it is preferred to use a rewritable storage unit such as an EEPROM.

The image memory 174 is utilized as a temporary storage region for image data and is also utilized as a program development region and a CPU processing work region.

The motor driver 176 is a driver (drive circuit) that drives the motor 188 of the conveyance system in accordance with an instruction from the system controller 172. The heater driver 178 is a driver that drives the heater 189 of the post-drying unit 142 in accordance with an instruction from the system controller 172.

The print control unit 180 functions as a signal processing unit that performs processing such as correction and various types of processing for creating signals for ejection control from the image information that has been transmitted from the system control unit 200 in accordance with the control of the system controller 172 and also controls ejection driving of the head 150 on the basis of created ink ejection data.

Below, a recording head adjusting method pertaining to the present embodiment will be described. First, the head 150 pertaining to the present embodiment has, as mentioned above, a width equal to or greater than the length of the width of the recording paper 116 in the width direction of the recording paper 116, and, as has been described in FIG. 3, the head 150 is disposed with sub-heads that include plural nozzles that eject liquid droplets at same timings with respect to the recording paper 116.

Figure 8:
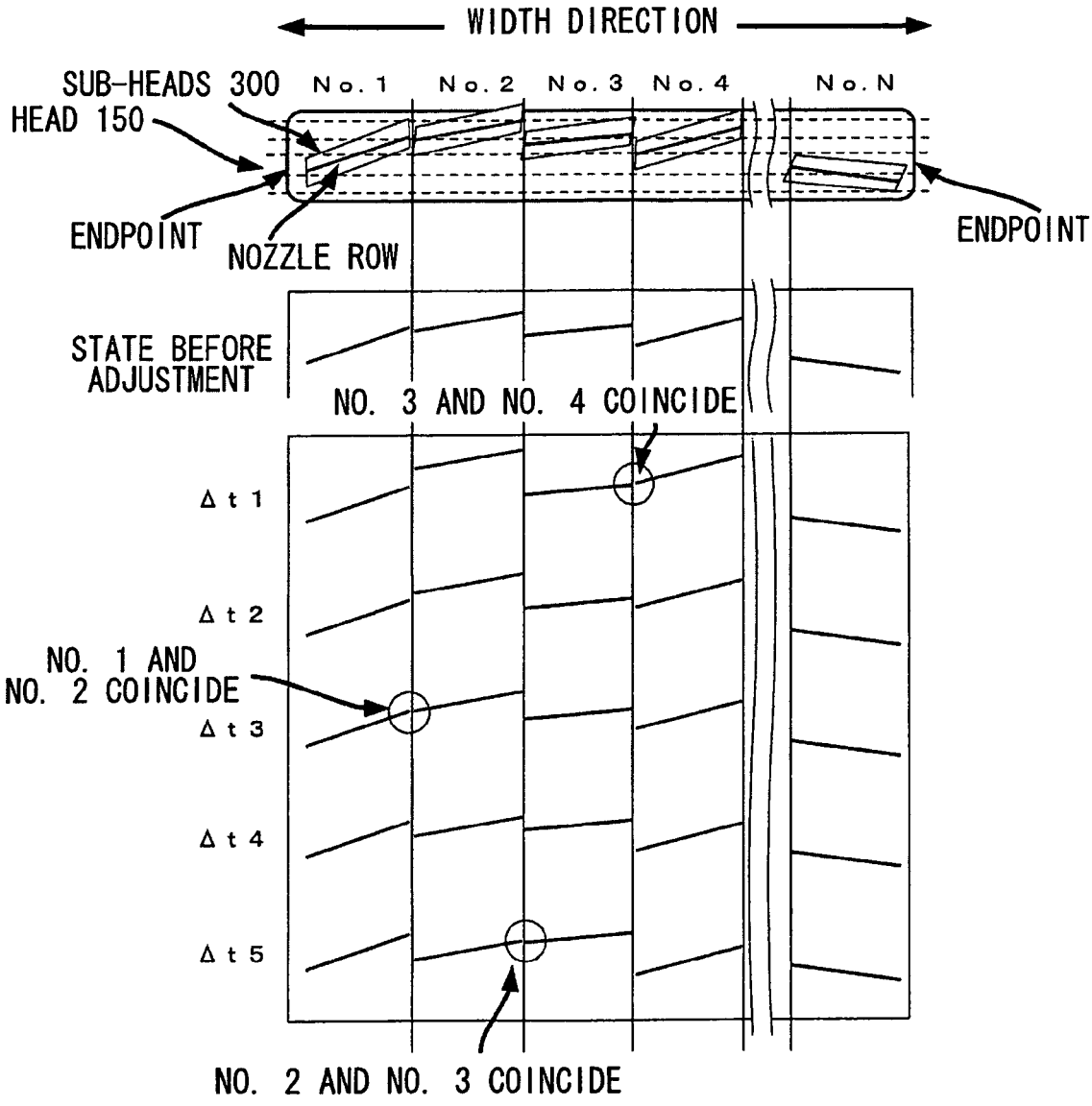
FIG. 8 is a diagram showing a method of deriving a shift amount of timings when sub-heads other than a predetermined sub-head eject liquid droplets.

Additionally, the head 150 is, as shown in head 150 of FIG. 8, one where plural sub-heads 300 are arranged in the width direction. In FIG. 8, the sub-heads 300 serve as the plural sub-heads, and N-number (No. 5 to No. N−1 are omitted) of the sub-heads 300 are shown. Moreover, when the sub-heads 130 have been attached to the head 150 ideally without shift, they are capable of forming, on the recording paper 116, a straight line parallel to the width direction.

Using FIG. 8, there will now be described a method of deriving, on the basis of information representing a pattern that has been formed by a predetermined sub-head 300 one time or at a shifted timing and has been read by the aforementioned printing detecting unit 124, a shift amount of timings when sub-heads 300 other than the predetermined sub-head 300 eject liquid droplets. It will be noted that, in the description below, a straight line is used as the pattern.

In FIG. 8, the predetermined sub-head 300 is the No. 1 sub-head 300. Additionally, the sub-heads 300 other than the predetermined sub-head 300 are the No. 2 to No. 4 sub-heads 300. Further, the state before adjustment shown in FIG. 8 represents straight lines formed in a state where adjustment of a shift amount has not been performed.

In FIG. 8, just the timings of the even-numbered sub-heads 300 (No. 2 and No. 4) are shifted to form one horizontal line or plural horizontal lines (lattice pattern) as shown in FIG. 8.

Additionally, a shift amount where endpoints connect is derived. In the example of FIG. 8, a time Δt is used in order to derive a shift amount. When this Δt is used, with respect to the respective sub-heads 300, Δt3 becomes the optimum parameter in sub-heads No. 1 and No. 2, Δt5 becomes the optimum parameter in sub-heads No. 2 and No. 3, and Δt1 becomes the optimum parameter in sub-heads No. 3 and No. 4. It will be noted that Δtn=Δt×n.

A correction amount Ti of No. i sub-head 300 is derived by the following expression using this Δt.

$$Ti=\Sigma T(k,k+1)$$

It will be noted that Σ represents a sum in k=1, . . . , i−1. Further, T (k, k+1) represents $\Delta tn\times(-1^{k+1})$ of No. k and No. k+1. For example, when k=1, then T (1, 2)=$\Delta t3\times(-1^{2})=\Delta t3$.

Figure 9:
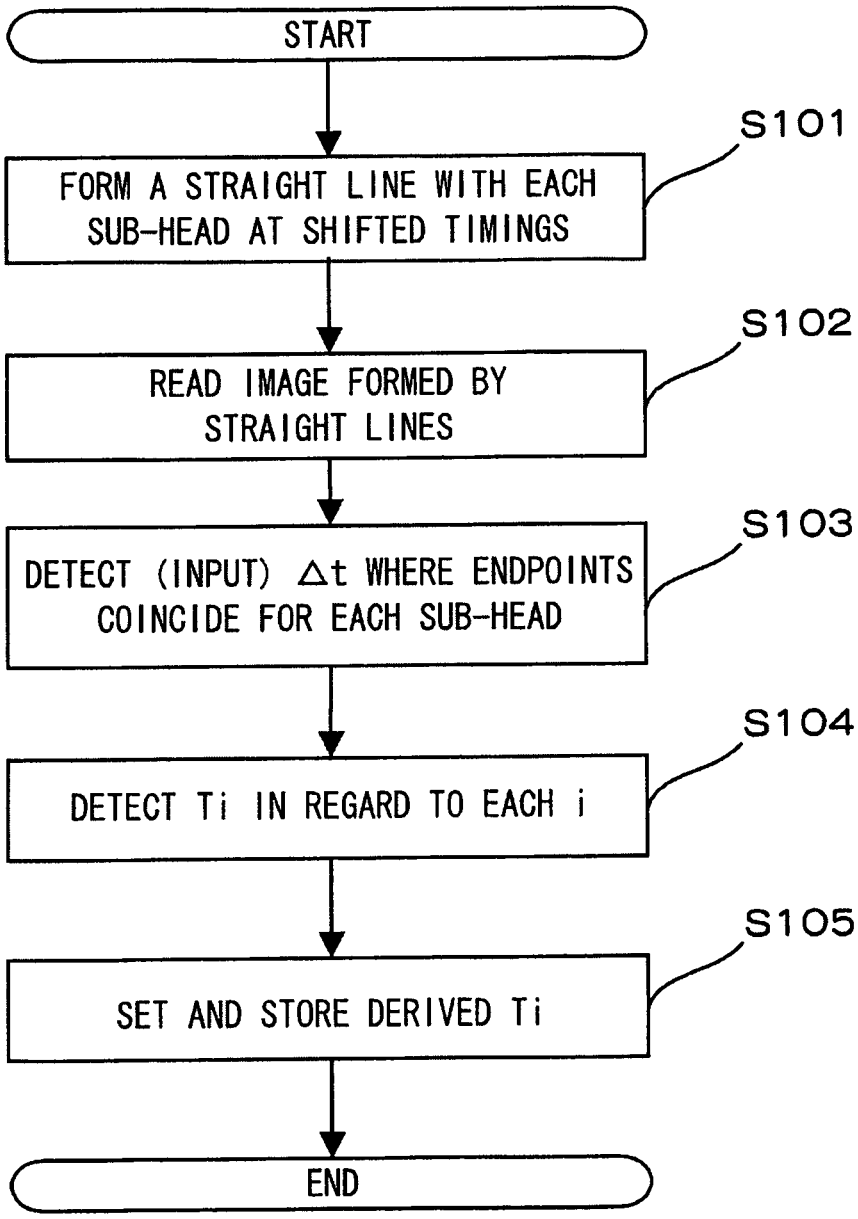
FIG. 9 is a flowchart showing a flow of ejecting timing adjustment processing.

The processing that has been described above will be described using the flowchart of FIG. 9. First, in step 101, a straight line is formed by each of the sub-heads 300 at shifting timings. In the preceding example, the even-numbered sub-heads 300 form straight lines at shifting timings.

In the next step 102, the image where the straight lines have been formed is read by the printing detecting unit 124. In step 103, Δt where endpoints coincide is detected (or inputted) for each of the sub-heads 300. This detection may, for example, be performed by detecting the position of the endpoint of the straight line formed by each of the sub-heads 300, detecting the endpoint of the straight line formed by the adjacent sub-head 300, and detecting Δt when there are formed endpoints where the distance between these two endpoints is the shortest.

"Input of Δt" means input by the operator. Specifically, the operator may judge Δt by visually evaluating unevenness of connecting portions formed by each of the sub-heads 300 or linearity of the lines and input Δt (e.g., Δt3 in the No. 1 and No. 2 sub-heads 300) as the judgment result. In this case, an interface for the operator to input that judgment result is disposed in the inkjet recording apparatus 110, and the judgment result that has been inputted thereby is set in later-described step 105. Further, in a case where the operator inputs the judgment result, step 102 is unnecessary.

Ti is derived in regard to each i using the aforementioned expression in step 104 by Δt that has been detected or Δt that has been inputted.

In the next step 105, Ti that has been derived is set and, if necessary, if the image memory 174 or the ROM 175 is rewritable, Ti may also be stored in those.

Figure 10:
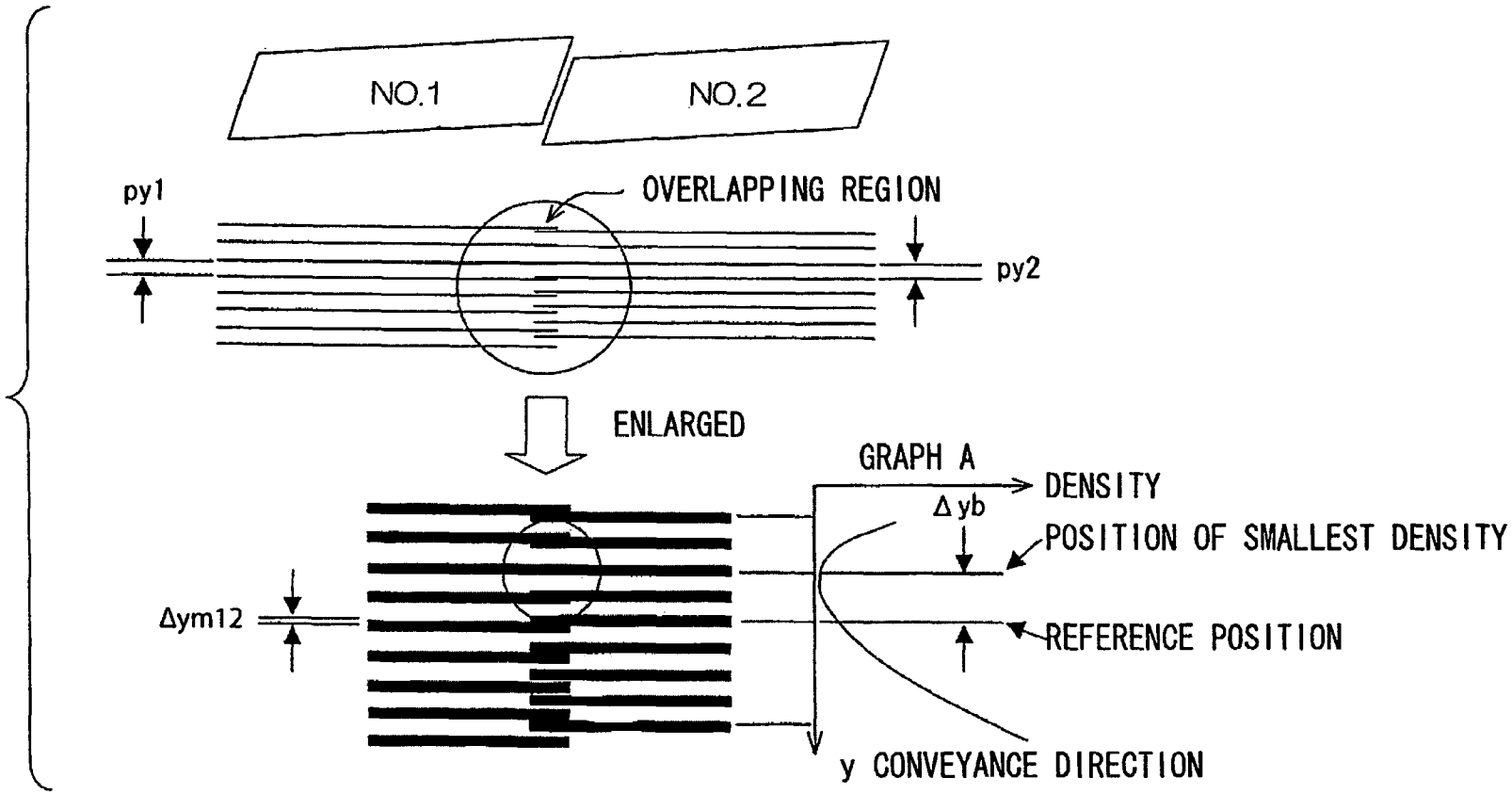
FIG. 10 is a diagram showing a method of deriving a shift amount of timings when the sub-heads eject liquid droplets.

Next, a shift amount deriving method different from the aforementioned method will be described. First, an overlapping region is present in a region where, of the sub-heads 300 of the inkjet recording apparatus 110 pertaining to the present embodiment, two sub-heads 300 that are adjacent are capable of forming the image on the recording paper 116. Specifically, as shown in FIG. 10, each of the sub-heads 300 (in the drawing, simply No. 1 and No. 2; these will be regarded as and represent a sub-head) has a rhombic shape, and sides of the two sub-heads 300 slant with respect to the conveyance direction. Moreover, the sub-heads 300 have a shape where the slanting sides of the different sub-heads 300 are fitted together. For that reason, the region corresponding to the sides that slant and are fitted together is a region capable of being formed from any of the sub-heads 300.

Focusing now on that region, plural straight lines are formed in parallel as shown in FIG. 10. Further, an interval py1 between the straight lines that No. 1 forms and an interval py2 between the straight lines that No. 2 forms are different.

As shown in the diagram where the overlapping region has been enlarged, because the intervals are different, overlapping is different between each of the straight lines. The extent of overlapping is expressed by density. A case where density is large means that the straight lines are overlapping in a state where shift is large, and a case where density is small means that the straight lines are overlapping in a state where shift is small.

Additionally, as shown in FIG. 10, Δyb represents the distance between a position where density is the smallest and a reference position. This reference position is a position that has been determined beforehand and, in the case of FIG. 10, is the position of the straight line positioned in the middle of the group of straight lines in the conveyance direction. Further, the position where density is the smallest is the position of the straight line corresponding to the position where density is the smallest shown in the curved line of graph A whose horizontal axis represents density and whose vertical axis represents the conveyance direction.

At this time, when Δym12 represents the shift amount at the reference position, then $\Delta yb/py2=\Delta ym12/(py1-py2)$ is established. Consequently, $\Delta ym12=\Delta yb(py1/py2-1)$.

In order to raise the determination precision of Δym12, it is preferred to make (py1−py2) into a conveyance direction (y) direction resolution of the inkjet recording apparatus 110. Further, it is preferred to make py1 and py2 large. However, when py1 and py2 are too large, the precision of reading Δyb drops and, as a result, the determination precision of Δym12 drops. Consequently, an optimum py is determined in consideration of the conveyance direction (y) direction resolution of the inkjet recording apparatus 110 and the necessary reading precision. Further, as for the line width of each straight line, an optimum width is determined from the appearance of the actual density distribution and the detection of the printing detecting unit 124.

The shift amount Δym can be precisely detected by the above method. Next, using density in the similar manner as before, detection of a position with the smallest shift amount will be described using FIG. 11.

Figure 11:
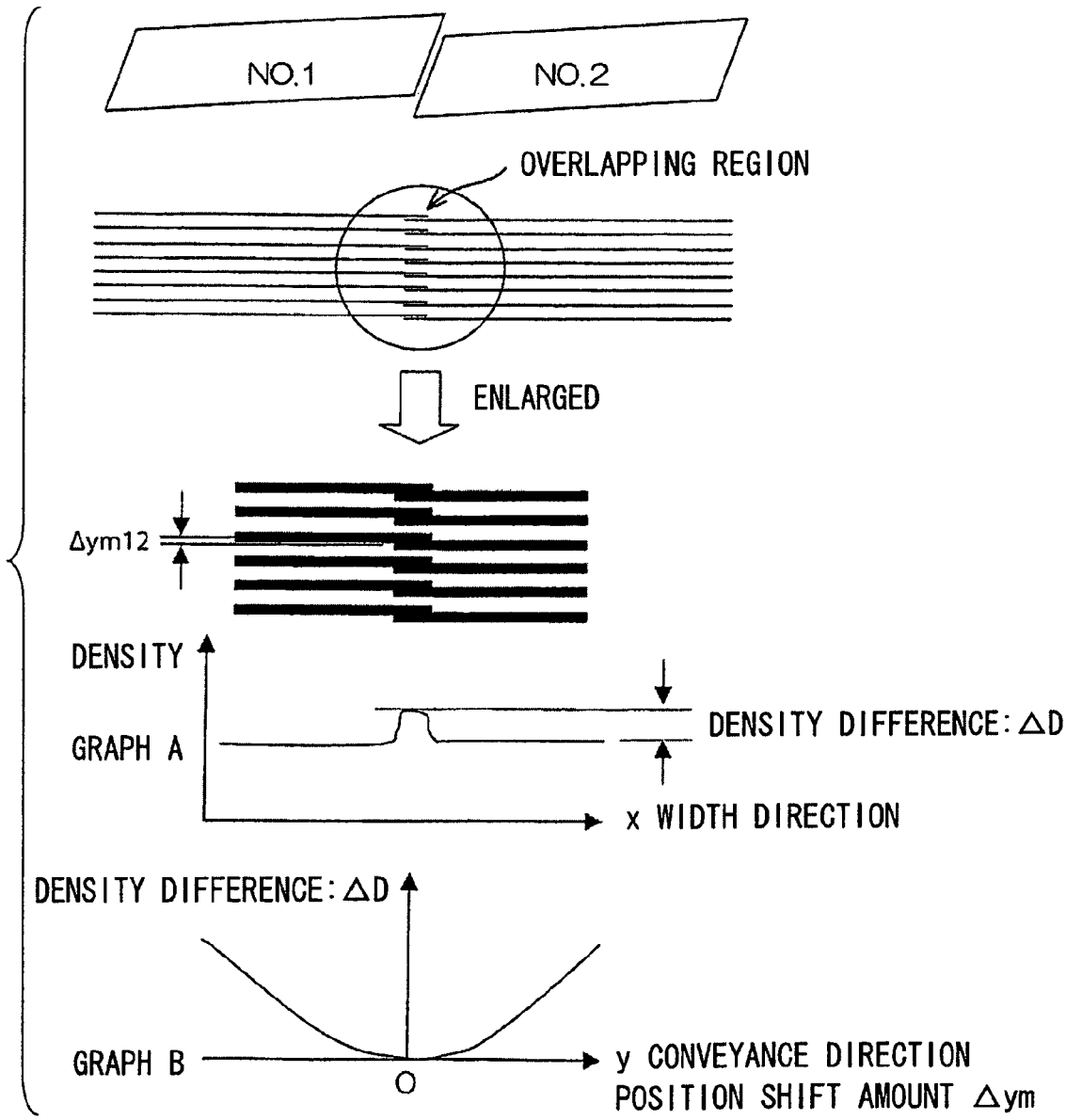
FIG. 11 is a diagram showing a method of detecting a position that has the smallest shift amount.

The group of straight lines shown in FIG. 11 are, in contrast to those in FIG. 10, all formed in equidistant intervals. Density in this case has a density difference shown in graph A whose horizontal axis represents the width direction and whose vertical axis represents density. Further, the relationship between the density difference ΔD and the shift amount Δym is shown in graph B whose vertical axis represents the density difference ΔD and whose horizontal axis represents the y conveyance direction position shift amount Δym. The position where density becomes the smallest becomes the position shown by this graph B.

In this manner, by detecting the density difference visually or with the printing detecting unit 124, the position where the shift amount is the smallest can be detected.

Next, a mechanism that uses the vicinity of one endpoint of the head 150 as a spindle to rotate and position the head 150 parallel to a plane of the recording paper 116 will be described.

Figure 12:
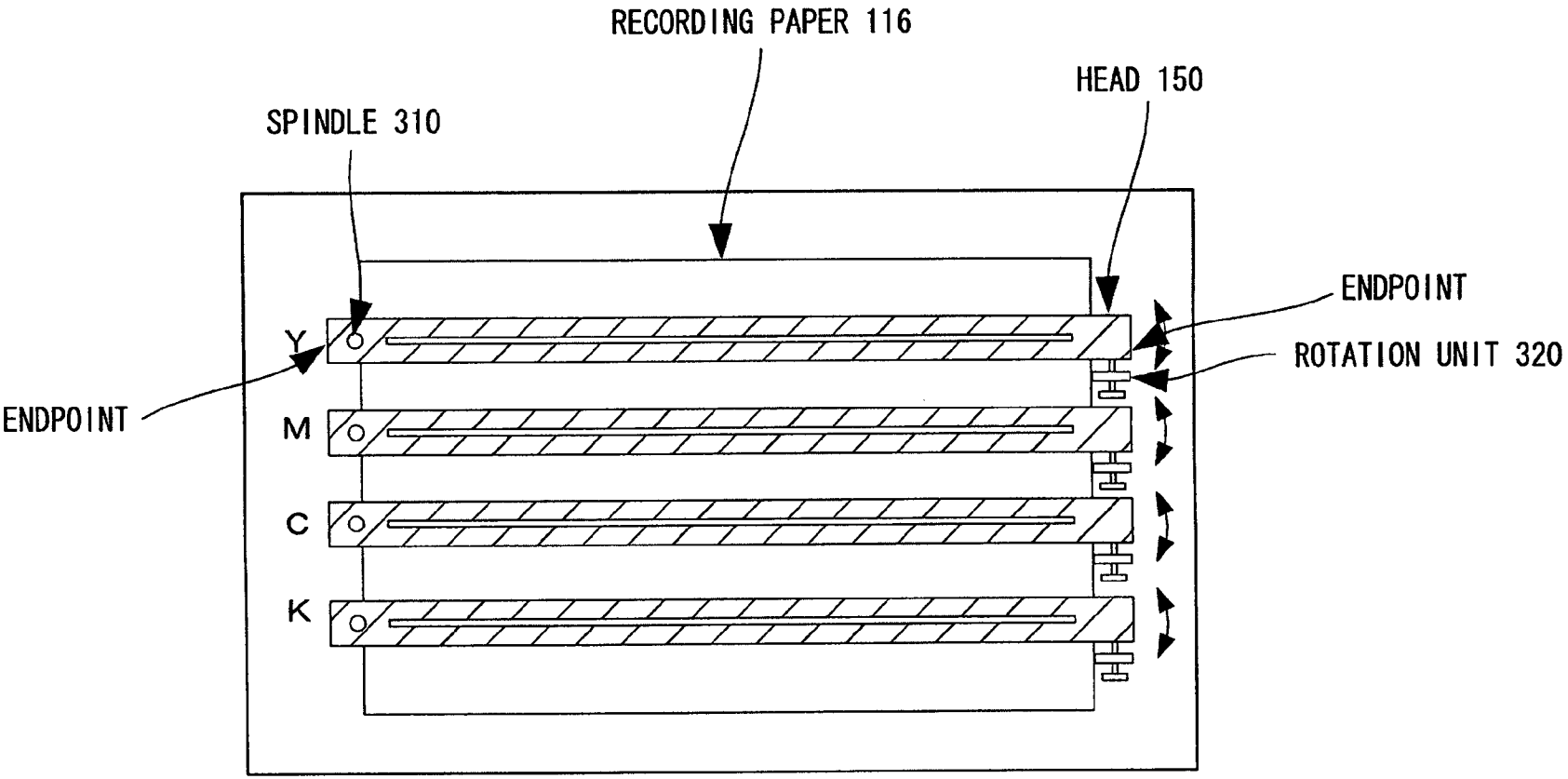
FIG. 12 is a diagram showing a rotation mechanism.

In FIG. 12, there are shown four heads 150 of YMCK, spindles 310 and rotation units 320. As shown in FIG. 12, each spindle 310 is located in the vicinity of one endpoint of each head 150. Further, each rotation unit 320 is, in the case of manual operation, configured to rotate the head 150 parallel to the plane of the recording paper 116 as a result of the operator rotating a screw and, when the operator stops rotating the screw, position the head 150 there. In the case of automatic operation, each rotation unit 320 is configured such that the screw is rotated by a stepping motor or the like by control of the system controller 172.

Figure 13:
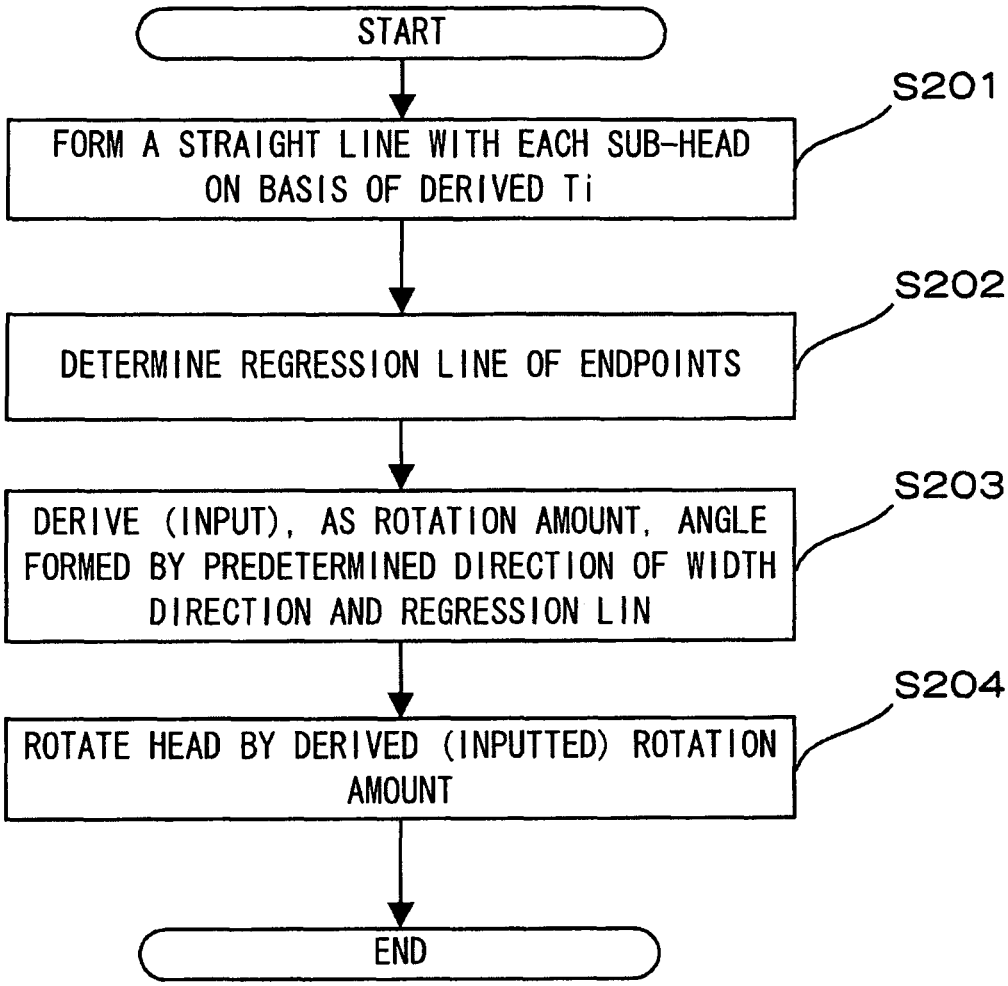
FIG. 13 is a flowchart showing a flow of rotation adjustment processing.

The processing that has been described above will be described using the flowchart of FIG. 13. First, in step 201, a straight line is drawn by each of the sub-heads 300 on the basis of Ti that has been derived. This straight line is formed as a result of ink being ejected from the one row of nozzles that has been determined beforehand and becomes a straight line whose endpoints are connected. In the next step 202, a regression line of all endpoints of the straight lines formed by the sub-heads 300 is determined. In the next step 203, an angle formed by a predetermined direction of the width direction and the regression line is derived (or inputted) as a rotation amount. In this manner, derivation of the rotation amount is performed on the basis of inclination, with respect to a predetermined direction, of the straight line that has been read by the printing detecting unit 124. It will be noted that, in addition to the aforementioned width direction, the predetermined direction may also be a direction based on the straight line that has been formed by the head 150 for forming K. Specifically, a regression line of all endpoints in the straight line that has been formed by the head 150 for forming K is determined, and a direction parallel to that regression line is used as the predetermined direction. Because K is a color that is easily noticeable to the human eye, color shift and unevenness of connecting portions can be controlled by using K as a reference.

"Input of rotation amount" is input by the operator. Specifically, the operator may input a rotation amount that the operator has visually determined to be a desired state using a ruler or the like, or the operator may determine and input an optimum rotation amount by forming a pattern while changing the rotation amount and visually determining a desired state. In this case, an interface for the operator to input that rotation amount is disposed in the inkjet recording apparatus 110, and the rotation amount that has been inputted thereby is used in later-described step 204. It will be noted that, in a case where the operator inputs the rotation amount, step 202 becomes unnecessary.

In the next step 204, the head 150 is rotated by the rotation amount that has been derived (inputted), and processing is ended.

Figures 14A, 14B, 14C, 14D:
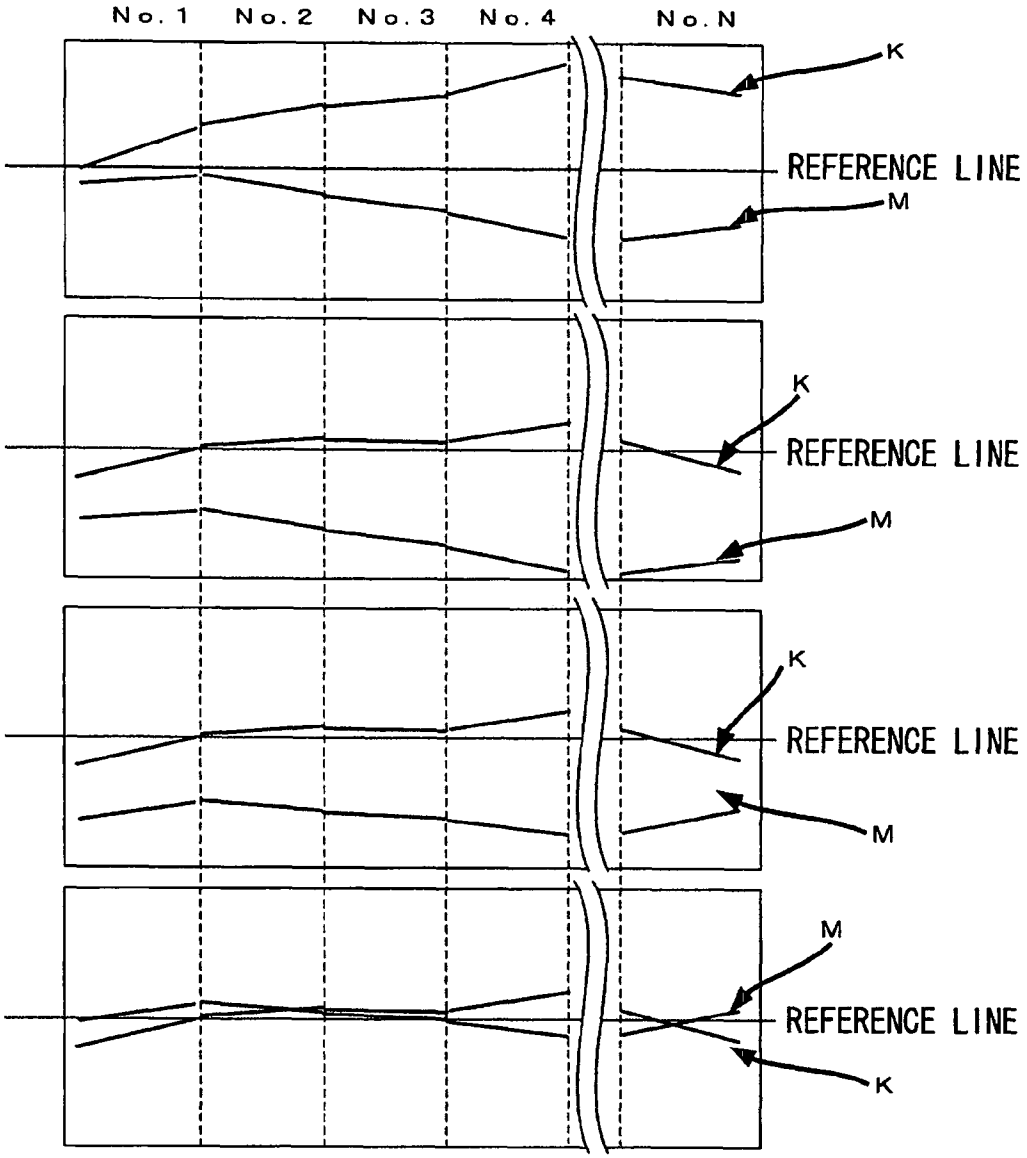
FIG. 14A to FIG. 14D are diagrams showing an example of a rotation method.

One example of the rotating method will be described using FIG. 14A to FIG. 14D. FIG. 14A to FIG. 14D show a case where heads 150 of two colors (in the drawing, K and M) are rotated. First, FIG. 14A shows straight lines in a state where just shift of the timings when the sub-heads 300 eject the liquid droplets has been adjusted. In the description below, the head 150 that corresponds to K will be called "head K", and the head 150 that corresponds to M will be called "head M".

In this state, as shown in FIG. 14B, head K is rotated so as to come closest to a reference line (an ideal line parallel to the width direction). By "come closest to a reference line" is meant that deviation in the conveyance direction between the straight lines that have been formed by head K and the reference line is the smallest.

Moreover, as shown in FIG. 14C, head M is rotated so as to come closest to the reference line. The ejection timing of head M is shifted from this state, whereby, as shown in FIG. 14D, the straight lines that all of the sub-heads 300 have formed also come closest to the reference line.

Figure 15A:
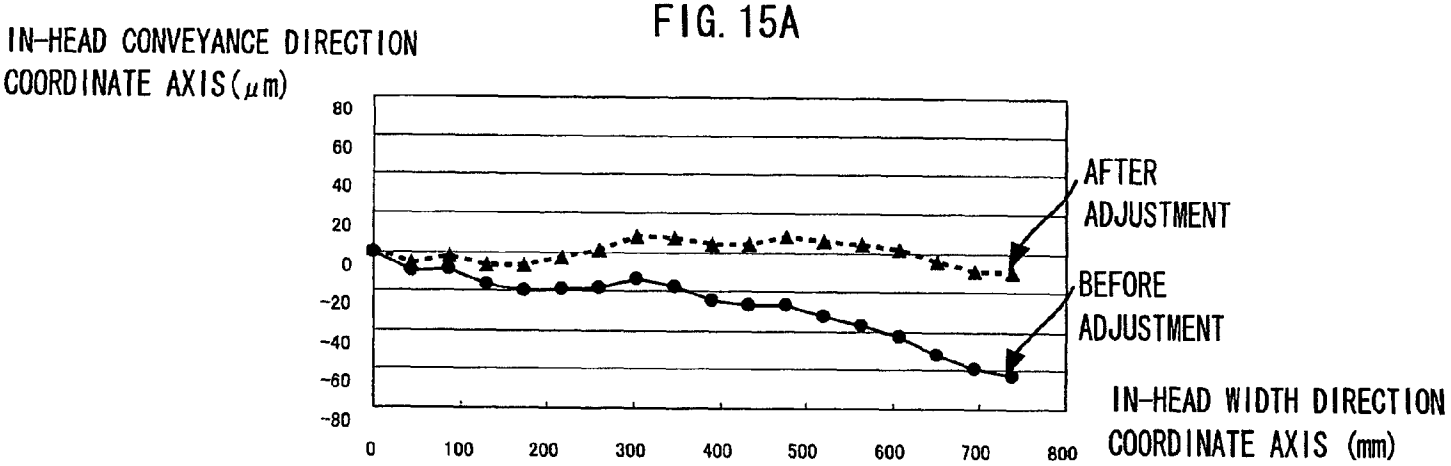
FIG. 15A and FIG. 15B are diagrams showing one verification result that has been improved by adjustment of ejection timings and heads.

One verification result that has been improved by the adjustment of ejection timings and heads that has been described above will be described using FIG. 15A and FIG. 15B. FIG. 15A shows how rotation has been adjusted inside the heads 150. The vertical axis represents an in-head conveyance direction coordinate axis, and the horizontal axis represents an in-head width direction coordinate axis. Additionally, points indicated by circles or triangles represent endpoints of the sub-heads 300.

Inclination of each of the sub-heads 300 occurs mainly due to manufacturing, so it is random. Whereas deviation from the reference line, where the in-head conveyance direction coordinate axis becomes 0, and which deviation has occurred because of random sub-head 300 inclination, is 63 μm before adjustment, it is reduced to 18 μm by rotation adjustment of the head 150.

Figure 15B:
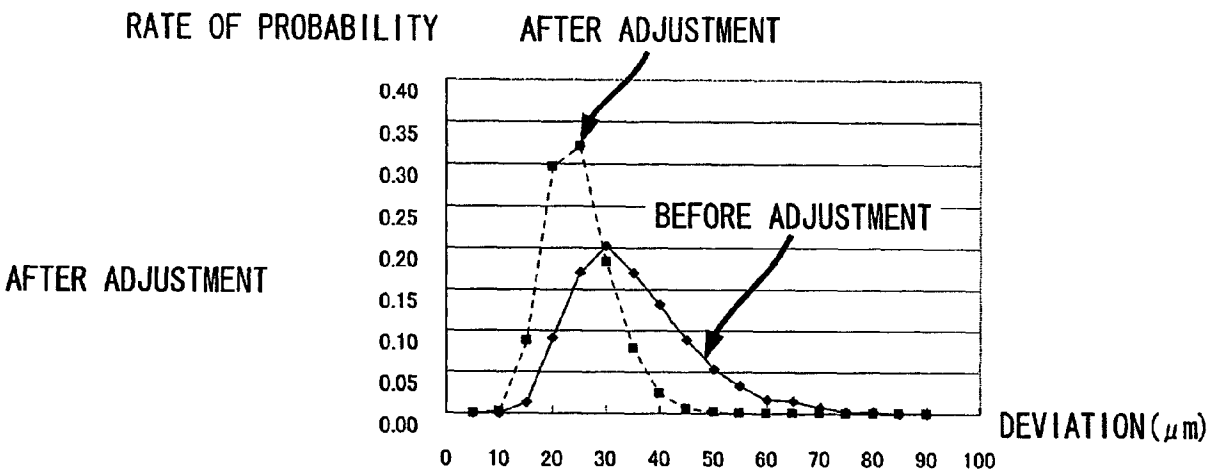

FIG. 15B shows a graph in a case where manufacturing error of 6500 of the heads 150 has been simulated, with the horizontal axis representing deviation and the vertical axis representing probability of occurrence.

As shown in FIG. 15B, deviation is kept to almost 60 μm or lower after adjustment. The acceptable amount of color shift is ordinarily said to be 60 μm because of visibility to the human eye. Consequently, it will be understood that color shift is adjusted to fall within a range where it cannot be seen.

Further, in FIG. 15A and FIG. 15B, an average value $+3\sigma$ before adjustment is up to 70μ, and an average value $+3\sigma$ after adjustment is up to 40μ.

Further, in regard to the connecting portions between the sub-heads 300, position shift in the conveyance direction does not arise, so unevenness of the connecting portions becomes of no concern. As a result, color shift and unevenness of connecting portions generated by misalignment of the sub-heads 300 can be controlled.

The embodiments that have been described above may also be applied to both transfer format inkjet recording apparatus and direct-drawing format inkjet recording apparatus.

Further, it suffices for the recording paper to be one to which inkjet liquid droplets adhere, such as ordinary paper, film, etc.

Although it has been described above, according to a first aspect of the invention, there is provided an image forming apparatus including: a recording head having plural sub-heads, the sub-heads each including plural nozzles, each of the plural nozzles within a sub-head ejecting liquid droplets at the same time with respect to a medium on which an image is drawn, and the sub-heads being arranged in a width direction of the medium; a setting unit that uses a timing when a predetermined sub-head of the plural sub-heads ejects liquid droplets as a reference to set timings when sub-heads other than the predetermined sub-head eject liquid droplets; and a rotation unit that uses a predetermined axis as a spindle to rotate and position the recording head in a plane parallel to a plane of the medium.

In the recording head, each of the plural sub-heads include plural nozzles, each of the plural nozzles within a sub-head eject liquid droplets at the same time with respect to a medium, and the sub-heads are arranged in a width direction of the medium. The setting unit uses a timing when a predetermined sub-head of the plural sub-heads ejects liquid droplets as a reference to set timings when sub-heads other than the predetermined sub-head eject liquid droplets. The rotation unit uses a predetermined axis as a spindle to rotate and position the recording head in a plane parallel to a plane of the medium.

In this manner, the setting unit sets the timings when sub-heads other than the predetermined sub-head eject liquid droplets, and the rotation unit rotates and positions the recording head in a plane parallel to a plane of the medium. Thus, there can be provided an image forming apparatus that can control color shift and unevenness of connecting portions generated by misalignment of sub-heads that eject liquid droplets.

According to a second aspect of the invention, in the first aspect, the image forming apparatus may further comprise a timing input unit to which is inputted information representing the timings when the sub-heads other than the predetermined sub-head eject the liquid droplets, wherein the setting unit may set, as the timings when the sub-heads other than the predetermined sub-head eject the liquid droplets, the timings represented by the information that has been inputted by the timing input unit.

Thus, the operator can input the timings when the sub-heads other than the predetermined sub-head eject the liquid droplets.

According to a third aspect of the invention, in the first aspect, the image forming apparatus may further comprise a rotation amount input unit to which is inputted information representing a rotation amount by which the recording head is to be rotated by the rotation unit, wherein the rotation unit may rotate and position the recording head in the plane parallel to the plane of the medium by the rotation amount represented by the information that has been inputted by the rotation amount input unit.

Thus, the rotation amount can be inputted by the operator.

According to a fourth aspect of the invention, in the first aspect, the image forming apparatus may further comprise an image reading unit that reads an image that has been formed on the medium by the recording head, and a shift amount derivation unit that derives, on the basis of information representing a pattern in the image that has been formed by the sub-heads and which pattern has been read by the image reading unit, a shift amount of the timings when the sub-heads other than the predetermined sub-head eject the liquid droplets, wherein the setting unit may set, on the basis of the shift amount that has been derived by the shift amount derivation unit, the timings when the sub-heads other than the predetermined sub-head eject the liquid droplets.

Thus, the timings when the sub-heads eject the liquid droplets can be automatically set by the shift amount derivation unit.

According to a fifth aspect of the invention, in the fourth aspect, an overlapping region may be present in a region where two sub-heads that are adjacent are capable of forming the image on the medium, and the shift amount derivation unit may derive, on the basis of overlapping of the pattern that has been formed in the overlapping region, the shift amount of the timings when the sub-heads other than the predetermined sub-head eject the liquid droplets.

Thus, because overlapping of the pattern is relatively easy to detect, the load of the image forming apparatus when deriving the shift amount can be alleviated.

According to a sixth aspect of the invention, in the first aspect, the image forming apparatus may further comprise an image reading unit that reads an image that has been formed on the medium by the recording head, a rotation amount derivation unit that derives a rotation amount on the basis of inclination, with respect to a predetermined direction, of a pattern in the image that has been formed by the sub-heads and which pattern is represented by information representing the pattern that has been obtained as a result of the pattern being read by the image reading unit, and a rotation controlling unit that controls the rotation unit such that the rotation unit rotates the recording head by the rotation amount that has been derived by the rotation amount derivation unit.

Thus, the recording head can be automatically rotated by the rotation amount derivation unit.

According to a seventh aspect of the invention, in the sixth aspect, the image forming apparatus may further comprise plural recording heads including a recording head for forming black color on the medium and a recording head for forming a color other than black color, wherein the predetermined direction may be a direction based on a pattern that has been formed by the recording head for forming black color.

Thus, because black color is a color that is easily noticeable to the human eye, color shift and unevenness of connecting portions can be controlled by using black color as a reference.

According to an eighth aspect of the invention, there is provided a recording head adjusting method including: using, in a recording head where plural sub-heads that include plural nozzles, each of the plural nozzles within a sub-head ejecting liquid droplets at the same time with respect to a medium on which an image is drawn and the sub-heads being arranged in a width direction of the medium, a timing when a predetermined sub-head of the plural sub-heads ejects liquid droplets as a reference to set timings when sub-heads other than the predetermined sub-head eject liquid droplets; and using a predetermined axis as a spindle to rotate and position the recording head in a plane parallel to a plane of the medium.

The method pertaining to the eighth aspect acts in the similar manner as the invention pertaining to the first aspect, so effects that are the similar as those of the invention pertaining to the first aspect are obtained.

According to a ninth aspect of the invention, in the eighth aspect, the recording head adjusting method may further comprise receiving input of information representing the timings when the sub-heads other than the predetermined sub-head eject the liquid droplets, wherein the setting may include setting, as the timings when the sub-heads other than the predetermined sub-head eject the liquid droplets, the timings represented by the information that has been inputted.

The method pertaining to the ninth aspect acts in the similar manner as the invention pertaining to the second aspect, so effects that are the similar as those of the invention pertaining to the second aspect are obtained.

According to a tenth aspect of the invention, in the eighth aspect, the recording head adjusting method may further comprise receiving input of information representing a rotation amount, wherein the rotating and positioning may include rotating and positioning the recording head in the plane parallel to the plane of the medium by the rotation amount represented by the information that has been inputted.

The method pertaining to the tenth aspect acts in the similar manner as the invention pertaining to the third aspect, so effects that are the similar as those of the invention pertaining to the third aspect are obtained.

According to an eleventh aspect of the invention, in the eighth aspect, the recording head adjusting method may further comprise reading an image that has been formed on the medium by the recording head, and deriving, on the basis of information representing a pattern in the image that has been formed by the sub-heads and which pattern is in the image that has been read, a shift amount of the timings when the sub-heads other than the predetermined sub-head eject the liquid droplets, wherein the setting may include setting, on the basis of the shift amount that has been derived, the timings when the sub-heads other than the predetermined sub-head eject the liquid droplets.

The method pertaining to the eleventh aspect acts in the similar manner as the invention pertaining to the fourth aspect, so effects that are the similar as those of the invention pertaining to the fourth aspect are obtained.

According to a twelfth aspect of the invention, in the eleventh aspect, an overlapping region may be present in a region where two sub-heads that are adjacent are capable of forming the image on the medium, and the deriving may include deriving, on the basis of overlapping of the pattern that has been formed in the overlapping region, the shift amount of the timings when the sub-heads other than the predetermined sub-head eject the liquid droplets.

The method pertaining to the twelfth aspect acts in the similar manner as the invention pertaining to the fifth aspect, so effects that are the similar as those of the invention pertaining to the fifth aspect are obtained.

According to a thirteenth aspect of the invention, in the eighth aspect, the recording head adjusting method may further comprise reading an image that has been formed on the medium by the recording head, deriving a rotation amount on the basis of inclination, with respect to a predetermined direction, of a pattern in the image that has been formed by the sub-heads and which pattern is represented by information representing the pattern in the image that has been obtained by reading the image, and controlling so as to rotate the recording head by the rotation amount that has been derived.

The method pertaining to the thirteenth aspect acts in the similar manner as the invention pertaining to the sixth aspect, so effects that are the similar as those of the invention pertaining to the sixth aspect are obtained.

According to a fourteenth aspect of the invention, in the thirteenth aspect, of plural recording heads including a recording head for forming black color on the medium and a recording head for forming a color other than black color, the predetermined direction may be a direction based on a pattern that has been formed by the recording head for forming black color.

The method pertaining to the fourteenth aspect acts in the similar manner as the invention pertaining to the seventh aspect, so effects that are the similar as those of the invention pertaining to the seventh aspect are obtained.

As described above, there can be provided an image forming apparatus that can control color shift and unevenness of connecting portions generated by misalignment of sub-heads that eject liquid droplets and a recording head adjusting method that adjusts shift that has arisen between the sub-heads.

Embodiments of the present invention are described above, but the present invention is not limited to the embodiments as will be clear to those skilled in the art.

What is claimed is:

1. An image forming apparatus comprising:

a recording head having plural sub-heads, the sub-heads each including plural nozzles, each of the plural nozzles within a sub-head ejecting liquid droplets at the same time with respect to a medium on which an image is drawn, and the sub-heads being arranged in a substantial single line in a width direction of the medium;

a setting unit that uses a timing when a predetermined sub-head of the plural sub-heads ejects liquid droplets as a reference to set timings when the other sub-heads which are arranged in a substantial single line with the predetermined sub-head eject liquid droplets;

a rotation unit that uses a predetermined axis as a spindle to rotate and position the recording head in a plane parallel to a plane of the medium;

a rotation amount derivation unit that derives a rotation amount on the basis of inclination, with respect to a direction corresponding to the width direction of the medium, of a regression line of all endpoints of straight lines that have been formed by the sub-heads; and a rotation controlling unit that controls the rotation unit such that the rotation unit rotates the recording head by the rotation amount that has been derived by the rotation amount derivation unit.

2. The image forming apparatus of claim 1, further comprising a timing input unit to which is inputted information representing the timings when the sub-heads other than the predetermined sub-head eject the liquid droplets, wherein the setting unit sets, as the timings when the sub-heads other than the predetermined sub-head eject the liquid droplets, the timings represented by the information that has been inputted by the timing input unit.

3. The image forming apparatus of claim 1, further comprising a rotation amount input unit to which is inputted information representing a rotation amount by which the recording head is to be rotated by the rotation unit, wherein the rotation unit rotates and positions the recording head in the plane parallel to the plane of the medium by the rotation amount represented by the information that has been inputted by the rotation amount input unit.

4. The image forming apparatus of claim 1, further comprising an image reading unit that reads an image that has been formed on the medium by the recording head, and a shift amount derivation unit that derives, on the basis of information representing a pattern in the image that has been formed by the sub-heads and which pattern has been read by the image reading unit, a shift amount of the timings when the sub-heads other than the predetermined sub-head eject the liquid droplets, wherein the setting unit sets, on the basis of the shift amount that has been derived by the shift amount derivation unit, the timings when the sub-heads other than the predetermined sub-head eject the liquid droplets.

5. The image forming apparatus of claim 4, wherein an overlapping region is present in a region where two sub-heads that are adjacent are capable of forming the image on the medium, and the shift amount derivation unit derives, on the basis of overlapping of the pattern that has been formed in the overlapping region, the shift amount of the timings when the sub-heads other than the predetermined sub-head eject the liquid droplets.

6. The image forming apparatus of claim 1, further comprising:

an image reading unit that reads an image that has been formed on the medium by the recording head, wherein the pattern that has been formed by the sub-heads is represented by information representing the pattern that has been obtained as a result of the pattern being read by the image reading unit.

7. The image forming apparatus of claim 6, further comprising plural recording heads including a recording head for forming black color on the medium and a recording head for forming a color other than black color, wherein the predetermined direction is a direction based on a pattern that has been formed by the recording head for forming black color.

8. A recording head adjusting method comprising:

using, in a recording head where plural sub-heads that include plural nozzles, each of the plural nozzles within a sub-head ejecting liquid droplets at the same time with respect to a medium on which an image is drawn and the sub-heads being arranged in a substantial single line in a width direction of the medium, a timing when a predetermined sub-head of the plural sub-heads ejects liquid droplets as a reference to set timings when the other sub-heads which are arranged in a substantial single line with the predetermined sub-head eject liquid droplets;

using a predetermined axis as a spindle to rotate and position the recording head in a plane parallel to a plane of the medium;

deriving a rotation amount on the basis of inclination, with respect to a direction corresponding to the width direction of the medium, of a regression line of all endpoints of straight lines that have been formed by the sub-heads; and controlling so as to rotate the recording head by the rotation amount that has been derived.

9. The recording head adjusting method of claim 8, further comprising receiving input of information representing the timings when the sub-heads other than the predetermined sub-head eject the liquid droplets, wherein the setting includes setting, as the timings when the sub-heads other than the predetermined sub-head eject the liquid droplets, the timings represented by the information that has been inputted.

10. The recording head adjusting method of claim 8, further comprising receiving input of information representing a rotation amount, wherein the rotating and positioning includes rotating and positioning the recording head in the plane parallel to the plane of the medium by the rotation amount represented by the information that has been inputted.

11. The recording head adjusting method of claim 8, further comprising reading an image that has been formed on the medium by the recording head, and deriving, on the basis of information representing a pattern in the image that has been formed by the sub-heads and which pattern is in the image that has been read, a shift amount of the timings when the sub-heads other than the predetermined sub-head eject the liquid droplets, wherein the setting includes setting, on the basis of the shift amount that has been derived, the timings when the sub-heads other than the predetermined sub-head eject the liquid droplets.

12. The recording head adjusting method of claim 11, wherein an overlapping region is present in a region where two sub-heads that are adjacent are capable of forming the image on the medium, and the deriving includes deriving, on the basis of overlapping of the pattern that has been formed in the overlapping region, the shift amount of the timings when the sub-heads other than the predetermined sub-head eject the liquid droplets.

13. The recording head adjusting method of claim 8, further comprising:

reading an image that has been formed on the medium by the recording head, wherein the pattern in the image that has been formed by the sub-heads is represented by information representing the pattern that has been obtained by reading the image.

14. The recording head adjusting method of claim 13, wherein, of plural recording heads including a recording head for forming black color on the medium and a recording head for forming a color other than black color, the predetermined direction is a direction based on a pattern that has been formed by the recording head for forming black color.

* * * * *